US011437751B2

(12) United States Patent
Duan et al.

(10) Patent No.: US 11,437,751 B2
(45) Date of Patent: Sep. 6, 2022

(54) CONNECTOR

(71) Applicant: Dongguan Luxshare Technologies Co., Ltd, Dongguan (CN)

(72) Inventors: Bai-Yu Duan, Dongguan (CN); Zhen Luo, Dongguan (CN); Xiao-Kai Wang, Dongguan (CN); Xiao-Ping Wu, Dongguan (CN)

(73) Assignee: DONGGUAN LUXSHARE TECHNOLOGIES CO., LTD, Dongguan (CN)

( * ) Notice: Subject to any disclaimer, the term of this patent is extended or adjusted under 35 U.S.C. 154(b) by 0 days.

(21) Appl. No.: 17/086,941

(22) Filed: Nov. 2, 2020

(65) Prior Publication Data

US 2021/0050687 A1 Feb. 18, 2021

(30) Foreign Application Priority Data

Apr. 24, 2020 (CN) ..... 202010332907.3

(51) Int. Cl.
*H01R 13/502* (2006.01)
*H01R 13/05* (2006.01)
*H01R 13/50* (2006.01)

(52) U.S. Cl.
CPC ..... *H01R 13/502* (2013.01); *H01R 13/057* (2013.01); *H01R 13/50* (2013.01)

(58) Field of Classification Search
CPC ..... H01R 13/057; H01R 13/502; H01R 13/50
USPC ..... 439/686
See application file for complete search history.

(56) References Cited

U.S. PATENT DOCUMENTS 7,249,966 B2 * 7/2007 Long ..... H01R 13/6587 439/490
7,421,184 B2 * 9/2008 Long ..... G02B 6/0008 439/490
7,641,515 B1 * 1/2010 Szczesny ..... H01R 13/6582 439/541.5
7,704,097 B1 * 4/2010 Phillips ..... H05K 9/0058 439/607.21
7,712,941 B2 * 5/2010 Tai ..... H01R 13/6658 439/490
8,189,982 B2 * 5/2012 Yang ..... G02B 6/4201 385/134
8,277,252 B2 * 10/2012 Fogg ..... H01R 13/6477 439/607.25

(Continued)

FOREIGN PATENT DOCUMENTS

CN 104977664 A 10/2015
CN 107111075 A 8/2017

(Continued)

*Primary Examiner* — Abdullah A Riyami
*Assistant Examiner* — Vladimir Imas
(74) *Attorney, Agent, or Firm* — Birch, Stewart, Kolasch & Birch, LLP

(57) ABSTRACT

A connector includes a housing, a first sandwich structure, and a support structure. The housing includes two accommodating cavities vertically adjacent to each other, where each accommodating cavity is used for receiving a docking connector. The first sandwich structure is disposed between the two accommodating cavities. The support structure penetrates two side walls of the housing and two side walls of the first sandwich structure to fix the first sandwich structure on the housing.

18 Claims, 13 Drawing Sheets

(56) References Cited

U.S. PATENT DOCUMENTS

| | | | | |
|---|---|---|---|---|
| 8,545,267 | B2 * | 10/2013 | Fogg | H01R 13/6477 439/607.25 |
| 8,545,268 | B2 * | 10/2013 | Fogg | H01R 13/6477 439/607.25 |
| 8,864,523 | B2 * | 10/2014 | Banakis | H01R 13/6585 439/607.25 |
| 8,870,595 | B2 * | 10/2014 | Schmitt | H01R 13/6587 439/607.25 |
| 9,893,472 | B1 | 2/2018 | Chen | |
| 10,575,442 | B2 | 2/2020 | Bucher | |
| 11,114,797 | B2 * | 9/2021 | Wang | G02B 6/4284 |
| 2005/0254257 | A1 * | 11/2005 | Long | H01R 12/00 362/581 |
| 2005/0254772 | A1 * | 11/2005 | Long | G02B 6/0008 385/146 |
| 2020/0295498 | A1 | 9/2020 | Lloyd et al. | |

FOREIGN PATENT DOCUMENTS

| | | | |
|---|---|---|---|
| TW | 201444192 | A | 11/2014 |
| TW | 201637298 | A | 10/2016 |
| TW | 201721990 | A | 6/2017 |
| TW | M545384 | U | 7/2017 |
| TW | 201735461 | A | 10/2017 |
| TW | I691829 | B | 4/2020 |

* cited by examiner

CONNECTOR

CROSS-REFERENCE TO RELATED APPLICATION

This non-provisional application claims priority under 35 U.S.C. § 119(a) to Patent Application No. 202010332907.3 filed in China, P.R.C. on Apr. 24, 2020, the entire contents of which are hereby incorporated by reference.

BACKGROUND

Technical Field

The present invention relates to a connector, and in particular, to a connector suitable for stacking.

Related Art

There are various input/output (I/O) connectors. Some common types of connectors include small form-factor pluggable (SFP) connectors, 10 gigabit small form factor pluggable (XFP) connectors, quad small form-pluggable (QSFP) connectors, and C form-factor pluggable (CXP) connectors. Such similar connectors are referred to as SFP-type connector systems. The SFP-type connector system has the advantages of small size and low power consumption, and therefore is widely used in the field of optical communication in telecommunications and data communication. It is well known in the art that the SFP-type connector system provides a plurality of connection channels through a housing structure of a combination configuration or a stacking configuration.

SUMMARY

However, it is found that a sandwich structure of a stacked connector has no simple and stable fixing structure. In view of this, the present invention provides a connector, where a support structure penetrates a sandwich structure and a housing to fix the sandwich structure on the housing, thereby resolving the foregoing problem that the sandwich structure has no simple and stable fixing structure.

In an embodiment, a connector includes a housing, a first sandwich structure, and a support structure. The housing includes two accommodating cavities vertically adjacent to each other, where each accommodating cavity is used for receiving a docking connector. The first sandwich structure is disposed between the two accommodating cavities. The support structure penetrates two side walls of the housing and two side walls of the first sandwich structure to fix the first sandwich structure on the housing.

In some embodiments, the two side walls of the housing and the two side walls of the first sandwich structure each include a first opening; a plurality of the first openings form a first opening group aligned along a straight line; and the support structure penetrates the first opening group.

In some embodiments, the two side walls of the housing and the two side walls of the first sandwich structure each include a second opening; a plurality of the second openings form a second opening group aligned along a straight line; and the support structure penetrates the second opening group.

In some embodiments, the support structure includes a first string piece penetrating the first opening group and a second string piece penetrating the second opening group.

In some embodiments, the support structure penetrates the first opening group and the second opening group in a one-piece manner.

In some embodiments, the first sandwich structure includes a body and a first positioning structure; the first positioning structure is disposed on a first end of the body; the first end of the body is adjacent to inlets of the two accommodating cavities; and the first positioning structure is clamped on the side wall of the housing.

In some embodiments, the first sandwich structure further includes a second positioning structure; the second positioning structure is disposed on a second end of the body; the second end is opposite to the first end and extends into the housing; and the second positioning structure is clamped on the side wall of the housing inside the housing.

In some embodiments, the housing further includes another two accommodating cavities that are located on sides of the two accommodating cavities and that are vertically adjacent to each other, the accommodating cavity and the another accommodating cavity adjacent to each other being separated by a middle wall; the connector further includes a second sandwich structure, and the second sandwich structure is disposed between the another two accommodating cavities; and the support structure penetrates the two side walls of the housing, the two side walls of the first sandwich structure, the middle wall, and two side walls of the second sandwich structure to fix the first sandwich structure and the second sandwich structure on the housing.

In some embodiments, the first sandwich structure and the second sandwich structure each include a body and at least a first positioning structure disposed on a first end of the body; the first end of the body is adjacent to an inlet of the housing; and each first positioning structure is clamped on the side wall of the housing or the middle wall.

In some embodiments, the first sandwich structure and the second sandwich structure each include a plurality of the first positioning structures disposed at diagonal positions and clamped on the side wall of the housing and the middle wall separately.

DETAILED DESCRIPTION

It should be noted that orientation or position relationships indicated by the terms such as "upper", "lower", "left", "right", "vertical", "horizontal", "inner", and "outer" are orientation or position relationships shown in the accompanying drawings, or orientation or position relationships for usual placement when the created product of any embodiment is used. The terms are merely used to facilitate the description of the implementation of the present invention and simplify the description rather than indicating or implying that the mentioned apparatus or component needs to have a particular orientation or needs to be constructed and operated in a particular orientation. Therefore, such terms should not be construed as limitations on the present invention. In addition, the terms "first", "second", and "third" are merely intended for distinguishing descriptions, and shall not be understood as an indication or implication of relative importance. In the description of the present invention, unless otherwise stated, "a plurality of" means two or more than two. It should further be noted that, unless otherwise explicitly stated and defined, the first feature being located "above" or "below" the second feature may include that the first and second features are in direct contact, and may further include that the first and second features are not in direct contact but are in contact through other features between them.

Figure 1:
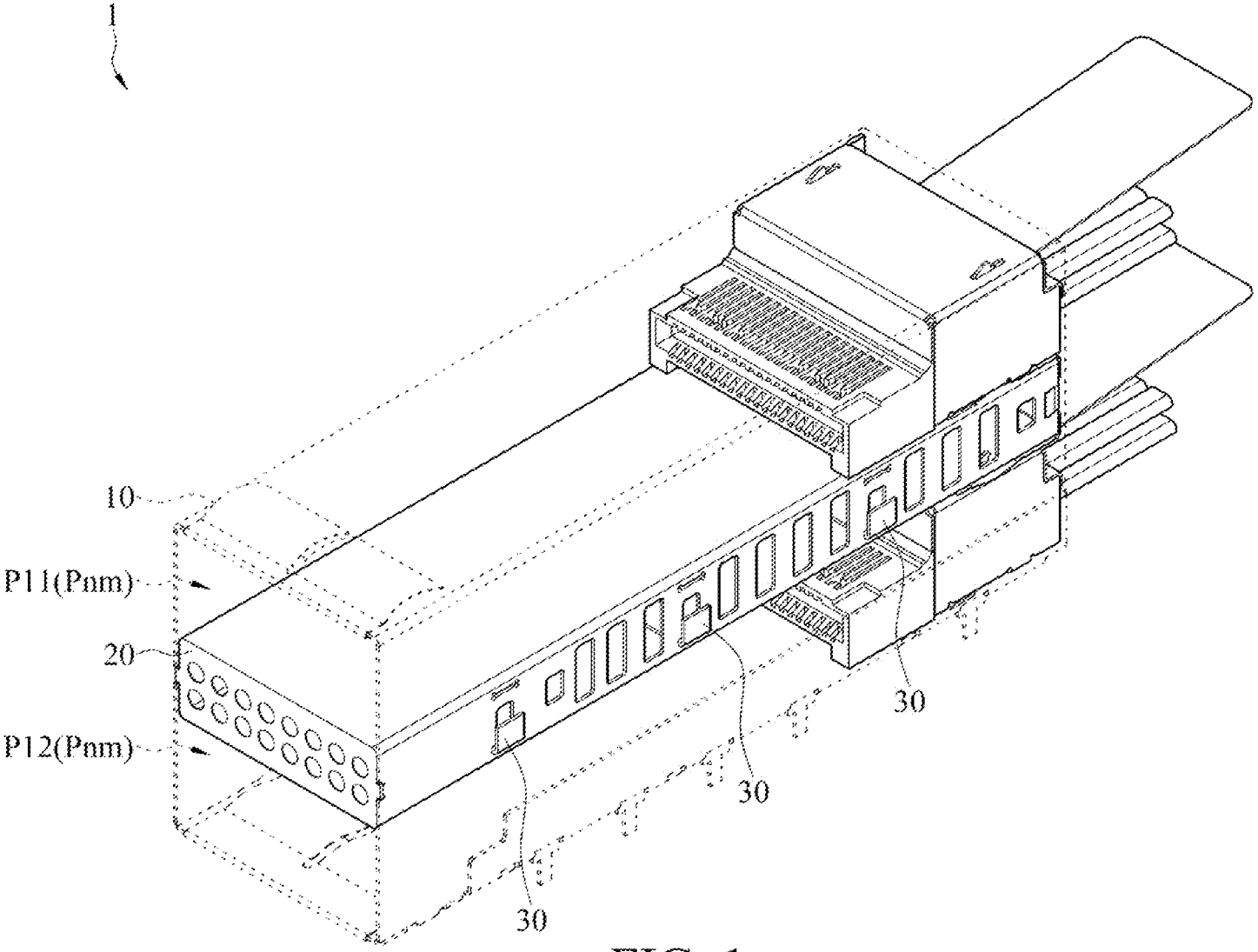
FIG. 1 is a three-dimensional schematic view of a connector according to a first embodiment.
Figure 2:
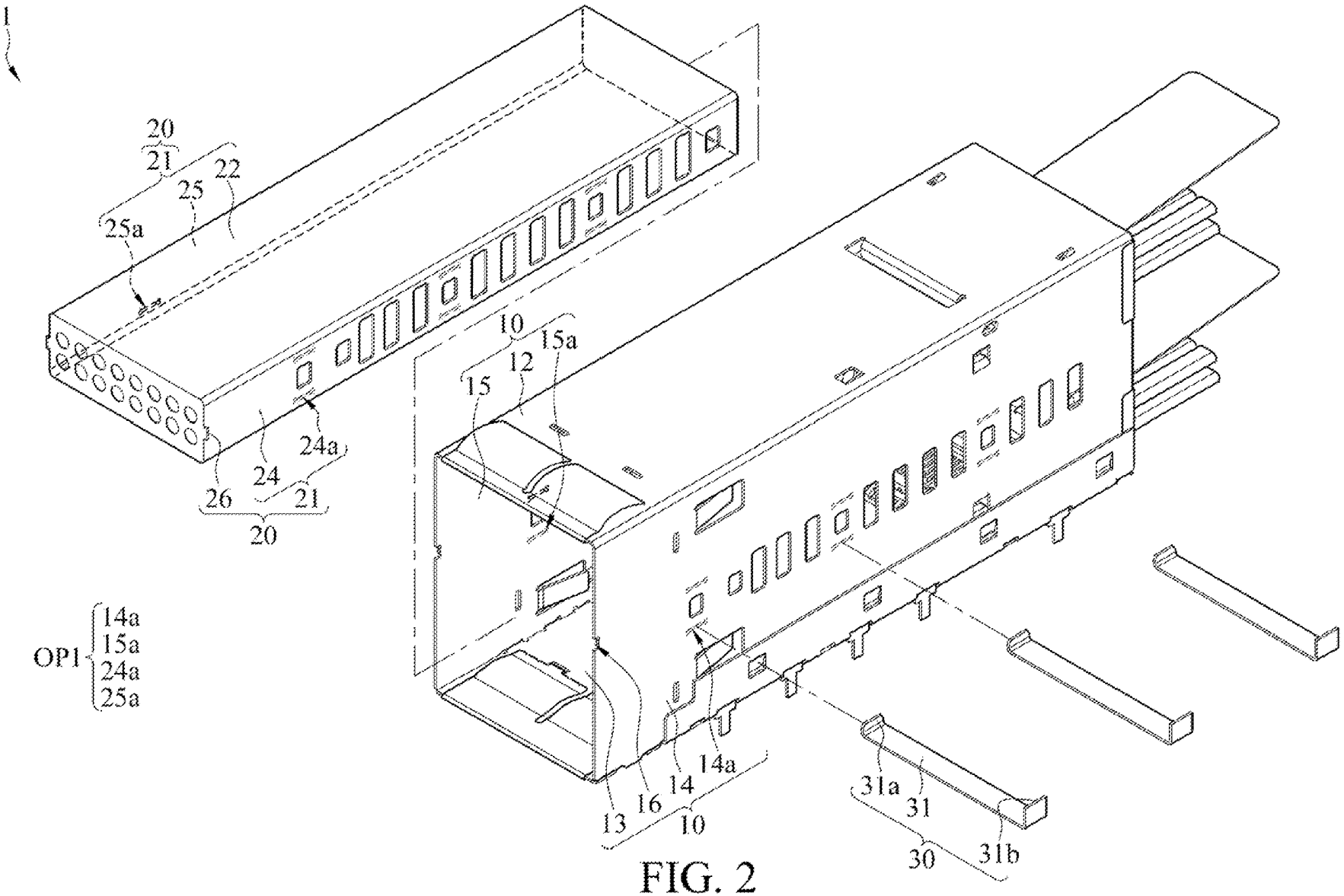
FIG. 2 is an exploded view of the connector in FIG. 1.

Referring to FIG. 1 and FIG. 2, a connector 1 includes a housing 10, a sandwich structure (hereinafter referred to as a first sandwich structure 20), and one or more support structures 30. For the sake of clarity, the housing 10 in FIG. 1 is shown in perspective, that is, the housing 10 is drawn with dotted lines.

Here, the housing 10 includes a plurality of accommodating cavities (hereinafter referred to as Pnm, n and m are positive integers). Each accommodating cavity Pnm is used for receiving a docking connector.

Taking the connector 1 of 2X1 configuration architecture as an example, the housing 10 includes two accommodating chambers P11 and P12 vertically adjacent to each other. The first sandwich structure 20 is disposed between the two accommodating cavities P11 and P12. In other words, the first sandwich structure 20 is located in the housing 10 to divide an accommodating space inside the housing 10 into the accommodating cavity P11 above and the accommodating cavity P12 below.

Here, the support structure 30 penetrates two side walls 14 and 15 of the housing 10 and two side walls 24 and 25 of the first sandwich structure 20 to fix the first sandwich structure 20 on the housing 10.

In some embodiments, the housing 10 may include a top wall 12, a bottom wall 13, and two side walls 14 and 15. The two side walls 14 and 15 are opposite to each other and coupled between the top wall 12 and the bottom wall 13. The top wall 12, the bottom wall 13, and the two side walls 14 and 15 enclose the accommodating space. The accommodating space is divided into a plurality of stacked accommodating cavities Pnm by the first sandwich structure 20. Each accommodating cavity Pnm includes an inlet located on an end of the housing 10 (that is, an opening for receiving the docking connector). The first sandwich structure 20 may include a top wall 22 and two side walls 24 and 25. The two side walls 24 and 25 are opposite to each other and are respectively coupled to two opposite sides of the top wall 22. Here, the side wall 24 of the first sandwich structure 20 abuts the side wall 14 of the housing 10, and the side wall 25 of the first sandwich structure 20 abuts the side wall 15 of the housing 10.

In some embodiments, referring to FIG. 1 and FIG. 2, the two side walls 14 and 15 of the housing 10 and the two side walls 24 and 25 of the first sandwich structure 20 each include one or more openings (hereinafter referred to as first openings 14*a*, 15*a*, 24*a*, and 25*a*). Here, the first openings 14*a*, 15*a*, 24*a*, and 25*a* aligned along a straight line form a first opening group OP1, and the support structure 30 penetrates the first opening group OP1. In other words, the connector 1 may further include one or more first opening groups OP1 corresponding to the one or more support structures 30 respectively. Each first opening group OP1 includes a first opening 14*a* penetrating the side wall 14 of the housing 10, a first opening 15*a* penetrating the side wall 15 of the housing 10, a first opening 24*a* penetrating the side wall 24 of the first sandwich structure 20, and a first opening 25*a* penetrating the side wall 25 of the first sandwich structure 20. The support structure 30 includes a string piece extending in a straight line (hereinafter referred to as a first string piece 31). The first string piece 31 passes through the corresponding first openings 14*a*, 15*a*, 24*a* and 25*a*, and is disposed in the first openings 14*a*, 15*a*, 24*a* and 25*a*. In an example, two ends of the first string piece 31 are respectively connected to bending sections 31*a* and 31*b*, and the bending sections 31*a* and 31*b* are crimped on outer surfaces of the two side walls 14 and 15 of the housing 10 respectively. In other words, two ends of the support structure 30 may protrude from outer sides of the two side walls 14 and 15 of the housing 10 respectively, and are crimped on the outer surfaces of the two side walls 14 and 15 of the housing 10 respectively after being bent. The support structure 30 penetrates the first opening group OP1 in a one-piece manner. In some embodiments, the bending section 31*a*, the first string piece 31, and the bending section 31*b* of the same support structure 30 may be in one piece. In some embodiments, each support structure 30 may include a single string piece (that is, a first string piece 31). In another embodiment, each support structure 30 may alternatively include a plurality of string pieces.

Figure 3:
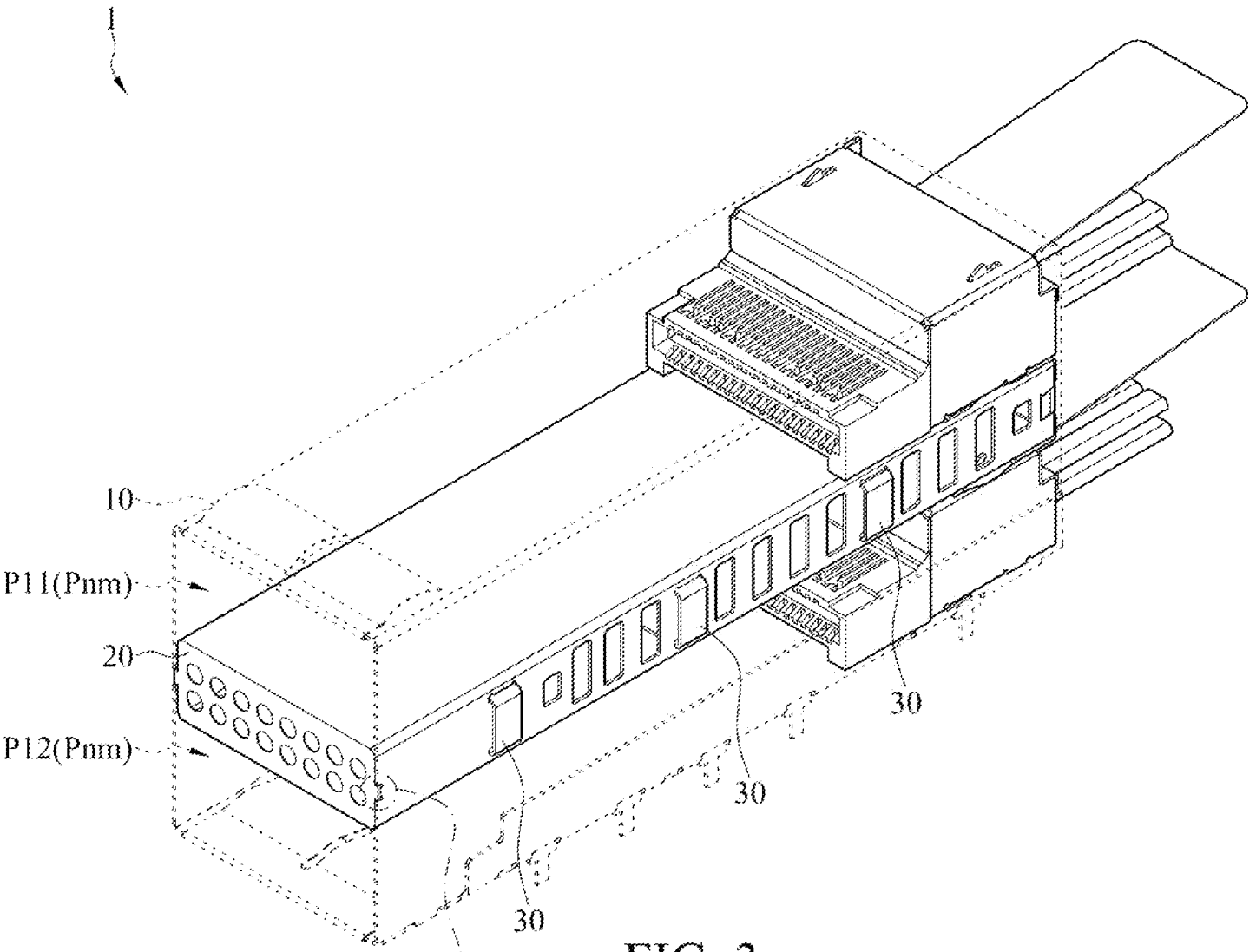
FIG. 3 is a three-dimensional schematic view of a connector according to a second embodiment.
Figure 4:
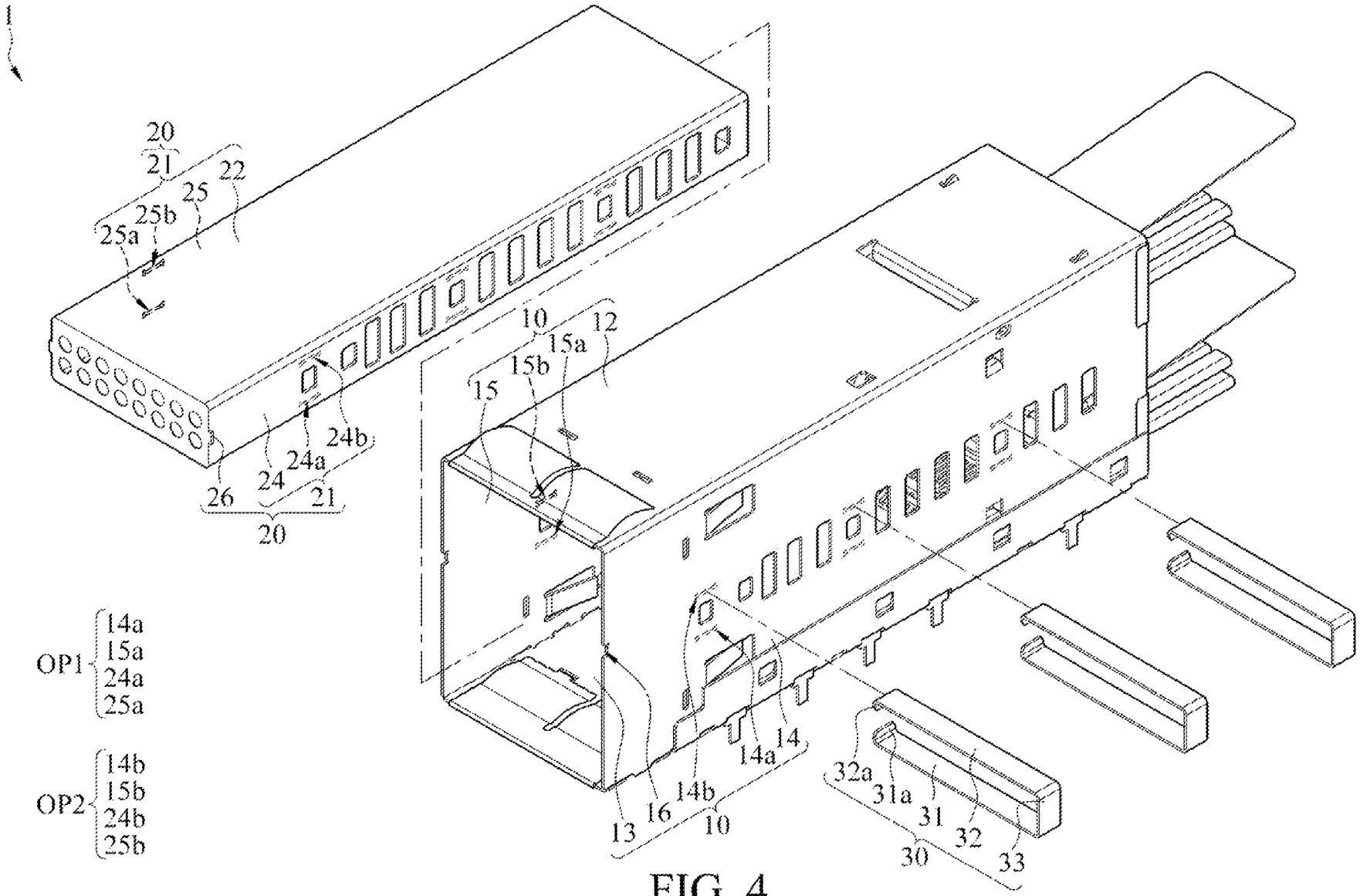
FIG. 4 is an exploded view of the connector in FIG. 3.

Referring to FIG. 3 and FIG. 4, for the sake of clarity, the housing 10 in FIG. 3 is shown in perspective, that is, the housing 10 drawn with dotted lines. In some embodiments, the two side walls 14 and 15 of the housing 10 and the two side walls 24 and 25 of the first sandwich structure 20 each further include another one or more openings (hereinafter referred to as second openings 14*b*, 15*b*, 24*b*, and 25*b*), in addition to the foregoing first openings 14*a*, 15*a*, 24*a* and 25*a*. Here, the second openings 14*b*, 15*b*, 24*b*, and 25*b* aligned along a straight line form a second opening group OP2, and the support structure 30 further penetrates the second opening group OP2. In other words, the connector 1 may further include one or more second opening groups OP2 corresponding to the one or more support structures 30 respectively. Each second opening group OP2 includes a second opening 14*b* adjacent to the first opening 14*a* and penetrating the side wall 14 of the housing 10, a second opening 15*b* adjacent to the first opening 15*a* and penetrating the side wall 15 of the housing 10, a second opening 24*b* adjacent to the first opening 24*a* and penetrating the side wall 24 of the first sandwich structure 20, and a second opening 25*b* adjacent to the first opening 25*a* and penetrating the side wall 25 of the first sandwich structure 20. The support structure 30 includes two string pieces (hereinafter referred to as a first string piece 31 and a second string piece 32) extending in a straight line. The first string piece 31 passes through the corresponding first openings 14*a*, 15*a*, 24*a* and 25*a*, and is disposed in the first openings 14*a*, 15*a*, 24*a* and 25*a*. The second string piece 32 passes through the corresponding second openings 14*b*, 15*b*, 24*b* and 25*b*, and is disposed in the second openings 14*b*, 15*b*, 24*b* and 25*b*. In an example, an end of the first string piece 31 and an end of the second string piece 32 are connected to each other by a connecting section 33. The first string piece 31 penetrates the corresponding first opening group OP1, and the second string piece 32 penetrates the second opening group OP2. The connecting section 33 is crimped on the outer surface of the side wall 15 of the housing 10. Another end of the first string piece 31 is connected to the bending section 31*a*, and another end of the second string piece 32 is connected to the bending section 32*a*. The bending sections 31*a* and 31*b* are crimped on the outer sides of the two side walls 14 and 15 of the housing 10 respectively. In other words, the support structure 30 may be a U-like structure. A middle section of the support structure 30 (that is, the connecting section 33) is crimped on the outer surface of the side wall 15 of the housing 10. Two ends of the support structure 30 are on the same side and protrude from the outer side of the side wall 14 of the housing 10, and is crimped on the outer surface of the side wall 14 of the housing 10 after being bent. The support structure 30 may penetrate the first opening group OP1 and the second opening group OP2 in a one-piece manner. For example, the bending section 31*a*, the first string piece 31, the connecting section 33, the second string piece 32, and the bending section 32*a* of the same support structure 30 may be in one piece. In another example, two ends of each string piece (that is, each of the first string piece 31 and the second string piece 32) are connected to the bending sections respectively, and the bending sections at the two ends of each string piece are crimped on the outer surfaces of the two side walls 14 and 15 of the housing 10 respectively.

Figure 5:
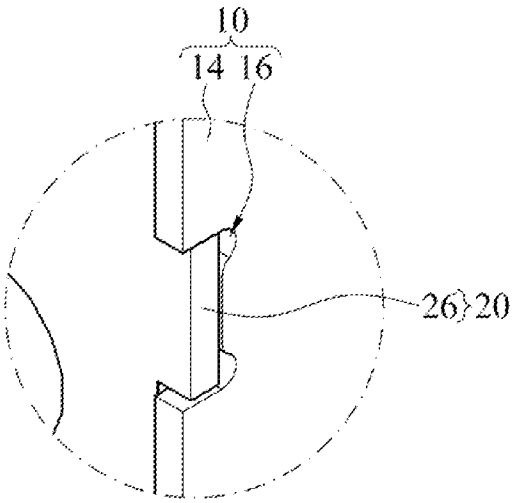
FIG. 5 is an enlarged view of an area A in FIG. 3.

In some embodiments, referring to FIG. 3 to FIG. 5, the first sandwich structure 20 may include a body 21 and one or more first positioning structures 26. Each first positioning structure 26 is disposed on a first end of the body 21. The first end of the body 21 is adjacent to the inlets of the two accommodating cavities P11 and P12. When the first sandwich structure 20 is located in the housing 10, each first positioning structure 26 is clamped on the side wall 14 (or 15) of the housing 10. In an example, each first positioning structure 26 may be a bump protruding from the first end of the body 21 toward the side wall 14 (or 15) of the housing 10. The side wall 14 (or 15) of the housing 10 is provided with a notch 16 at a position aligned with each first positioning structure 26. The bump (that is, the first positioning structure 26) is clamped within the corresponding notch 16 such that the first positioning structure 26 is clamped on the side wall 14 (or 15) of the housing 10. In an embodiment, the first sandwich structure 20 may include a single first positioning structure 26. In another embodiment, referring to FIG. 6 and FIG. 7, the first sandwich structure 20 may include a plurality of first positioning structures 26, and the plurality of first positioning structures 26 are disposed at diagonal positions.

Figure 6:
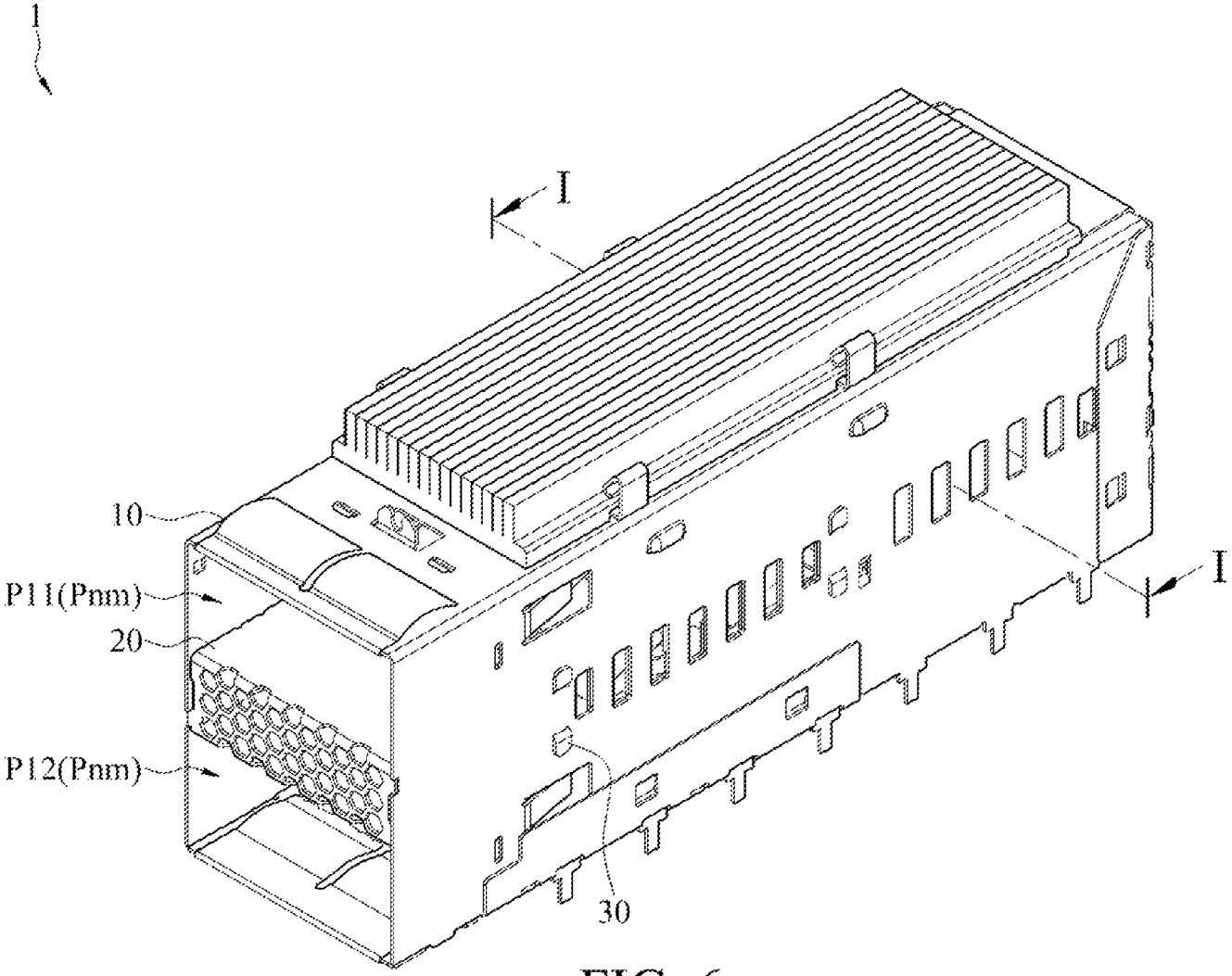
FIG. 6 is a three-dimensional schematic view of a connector according to a third embodiment.
Figure 7:
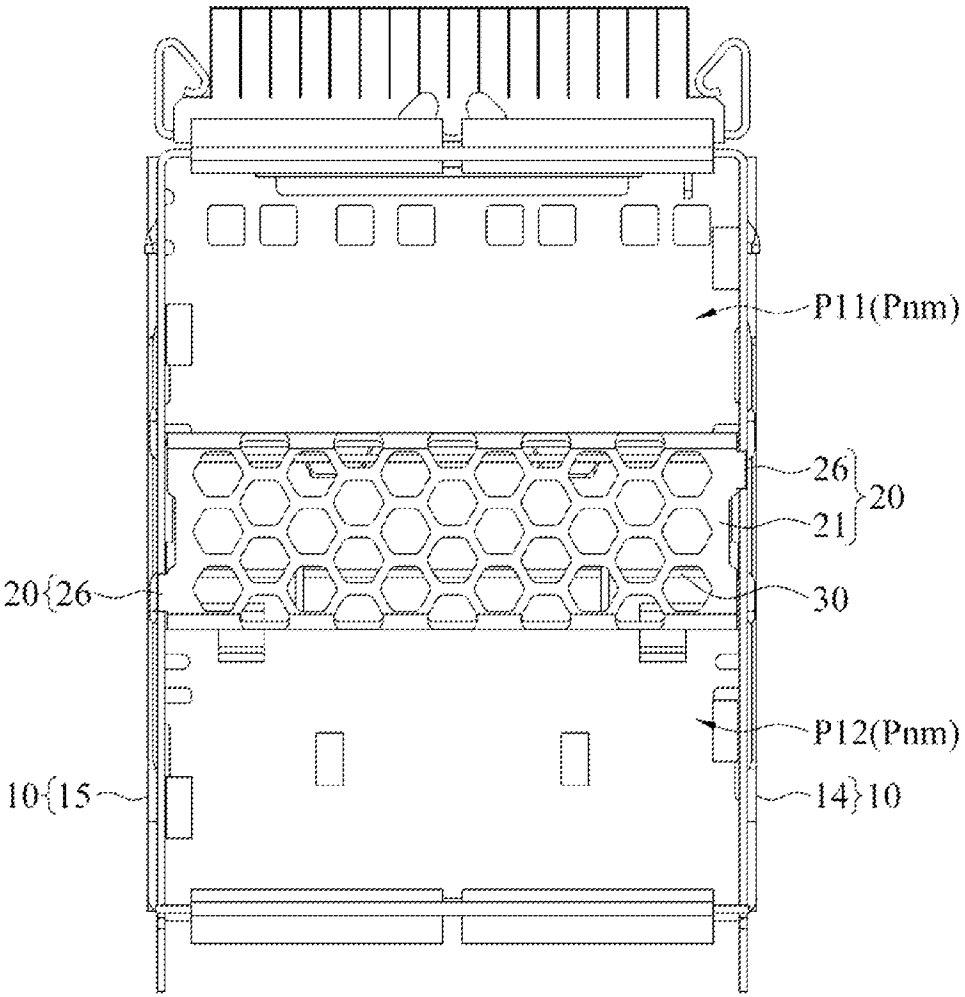
FIG. 7 is a front view of the connector in FIG. 6.
Figure 8:
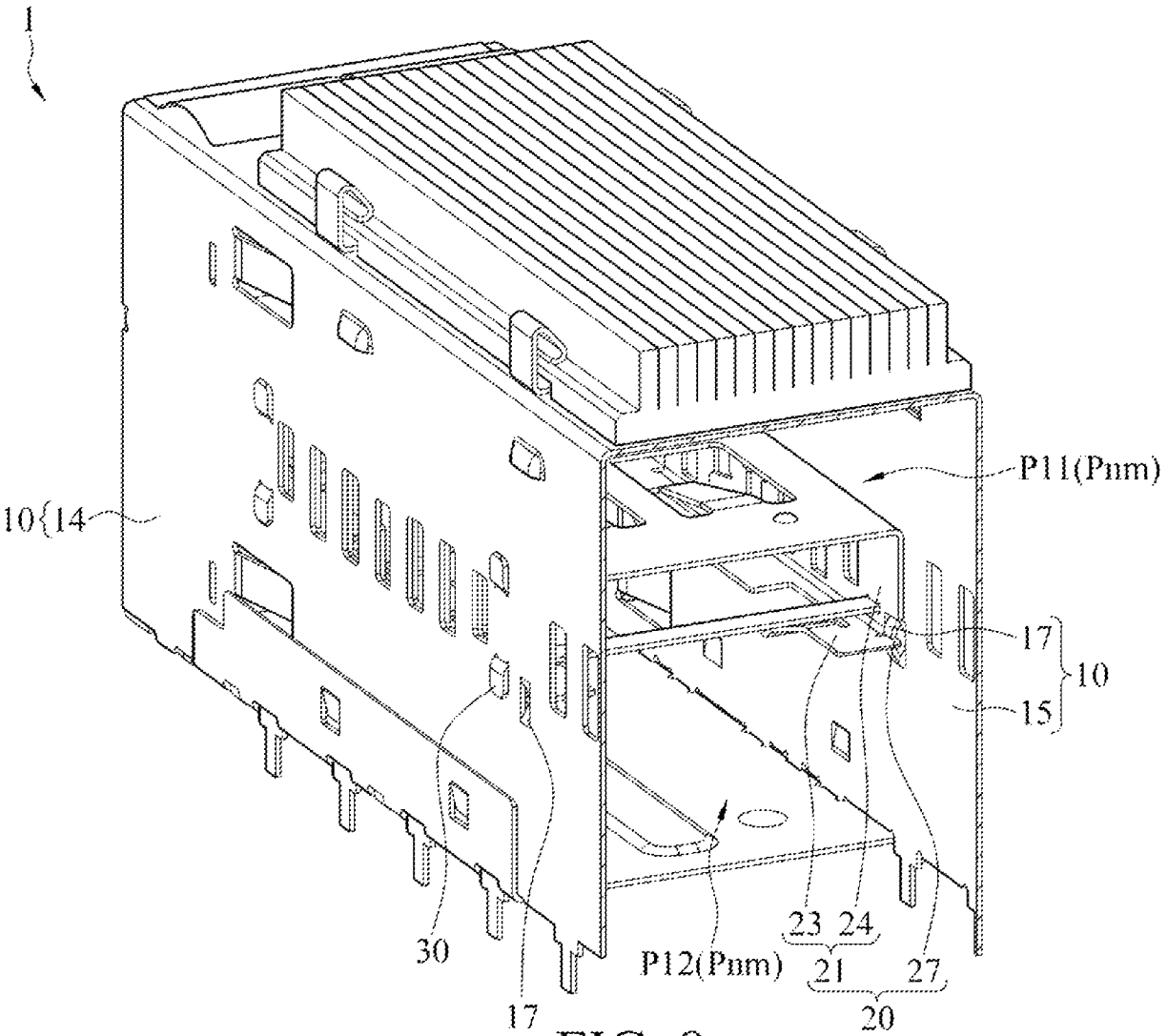
FIG. 8 is a sectional view taken along line I-I of FIG. 6 from an oblique viewing angle.

In some embodiments, referring to FIG. 6 and FIG. 8, the first sandwich structure 20 may further include one or more second positioning structures 27. Each second positioning structure 27 is disposed on a second end of the body 21. The second end of the body 21 is opposite to the first end of the body 21 and extends into the housing 10. When the first sandwich structure 20 is located in the housing 10, each first positioning structure 26 is clamped on the side wall 14 (or 15) of the housing 10, and each second positioning structure 27 is clamped on the side wall 14 (or 15) of the housing 10 inside the housing 10. In an example, each second positioning structure 27 may be a bump formed by an edge of the body 21 in a notch formed on the second end of the body 21. For example, the body 21 of the first sandwich structure 20 may include a bottom wall 23 and two side walls 24 and 25. The two side walls 24 and 25 are opposite to each other and are coupled to two opposite sides of the bottom wall 23 respectively. On the second end of the body 21, the corner of the juncture between the side wall 24 (or 25) and the bottom wall 23 is provided with a concave notch, and the bottom wall 23 is bump-like at the inner edge of the notch. The bump-like part of the bottom wall 23 is the second positioning structure 27. At a position aligned with each second positioning structure 27, the side wall 14 (or 15) of the housing 10 is provided with a clamping piece 17 protruding toward the inside of the accommodating cavity P12. The corresponding bump is clamped by the clamping piece 17 such that the second positioning structure 27 is clamped on the side wall 14 (or 15) of the housing 10.

In some embodiments, the accommodating space of the housing 10 may be divided into a plurality of accommodating cavities Pnm arranged in parallel by the middle wall 18.

Figure 9:
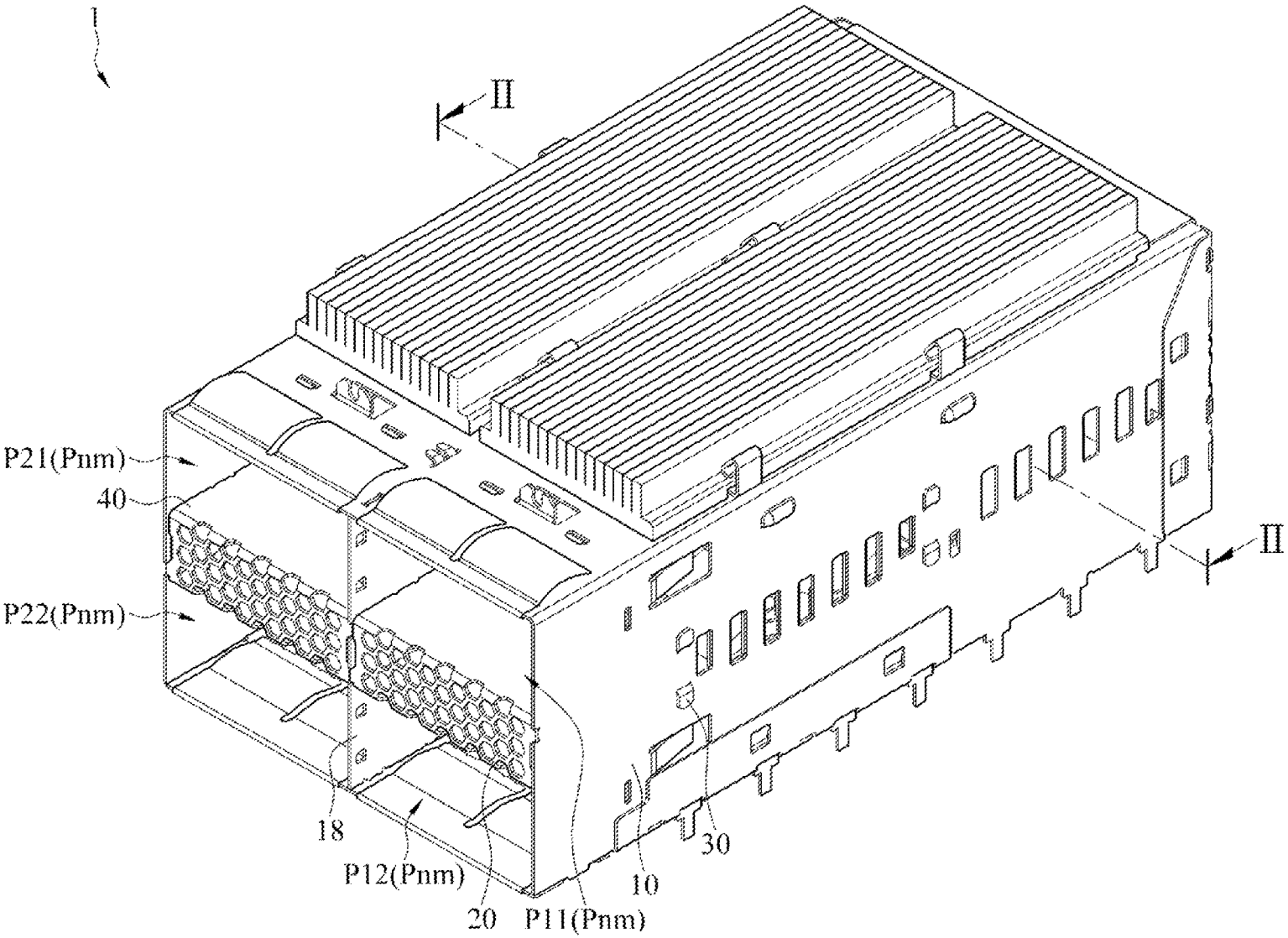
FIG. 9 is a three-dimensional schematic view of a connector according to a fourth embodiment.
Figure 10:
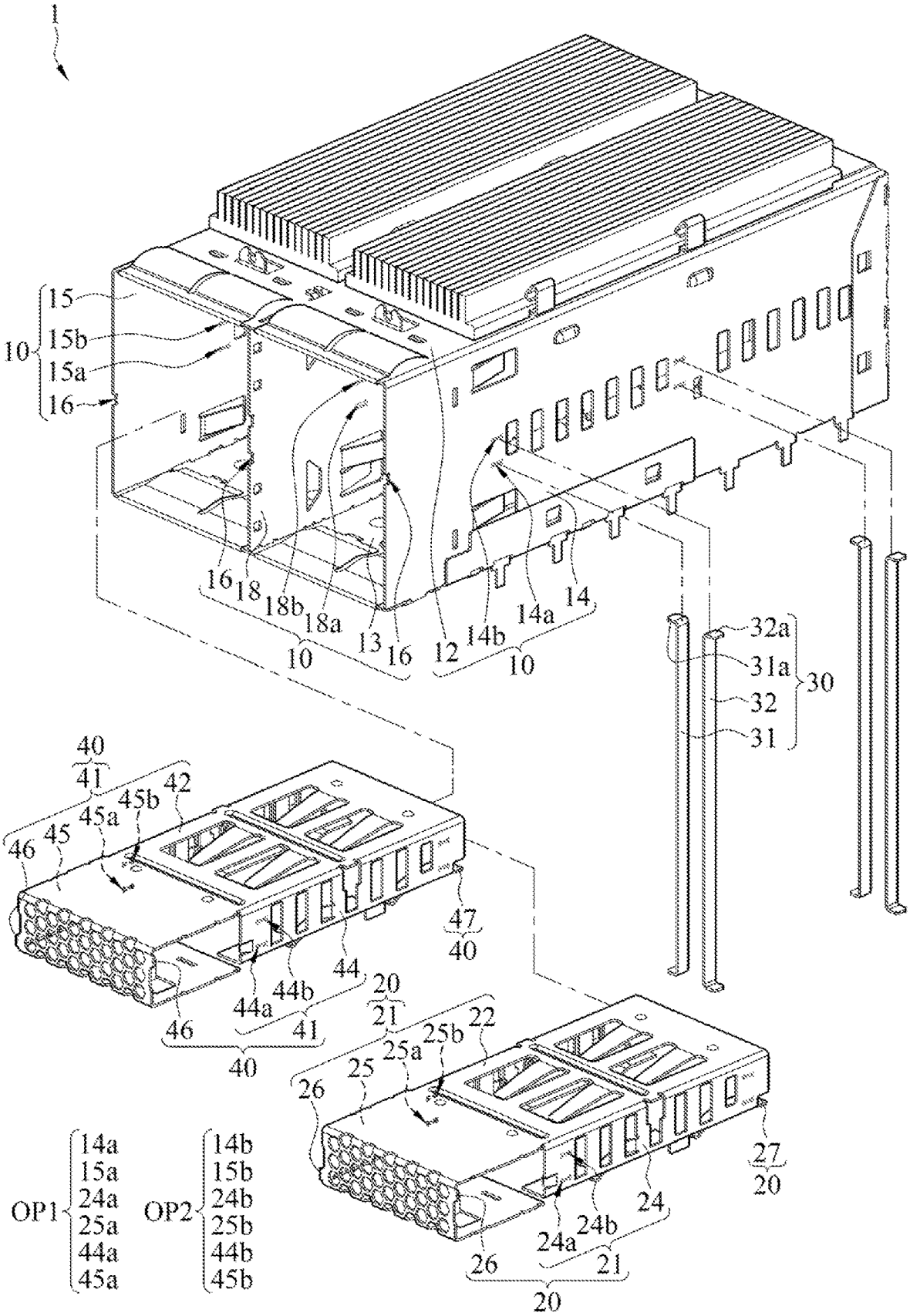
FIG. 10 is an exploded view of the connector in FIG. 9.

Taking the connector 1 of 2X2 configuration architecture as an example, referring to FIG. 9 and FIG. 10, the housing 10 further includes, besides the foregoing two accommodating cavities P11 and P12, another two accommodating chambers P21 and P22 that are disposed on sides of the two accommodating cavities P11 and P12 and that are vertically adjacent to each other. The two accommodating cavities P11 and P12 vertically adjacent to each other are separated by the first sandwich structure 20, and the another two accommodating chambers P21 and P22 vertically adjacent to each other are separated by another sandwich structure (hereinafter referred to as a second sandwich structure 40). In addition, the accommodating cavity P11 and the another accommodating cavity P21 adjacent to each other are separated by a middle wall 18, and the accommodating cavity P12 and the another accommodating cavity P22 adjacent to each other are separated by the middle wall 18. Here, the support structure 30 penetrates the two side walls 14 and 15 of the housing 10, the two side walls 24 and 25 of the first sandwich structure 20, the middle wall 18, and two side walls 44 and 45 of the second sandwich structure 40 to fix the first sandwich structure 20 and the second sandwich structure 40 on the housing 10.

In some embodiments, the two side walls 14 and 15 of the housing 10, the middle wall 18, the two side walls 24 and 25 of the first sandwich structure 20, and the two side walls 44 and 45 of the second sandwich structure 40 each include one or more openings (hereinafter referred to as first openings 14*a*, 15*a*, 18*a*, 24*a*, 25*a*, 44*a*, and 45*a*). Here, the first openings 14*a*, 15*a*, 18*a*, 24*a*, 25*a*, 44*a*, and 45*a* aligned along a straight line form a first opening group OP1, and the support structure 30 penetrates the first opening group OP1. In other words, the connector 1 may further include one or more first opening groups OP1 corresponding to the one or more support structures 30 respectively. Each first opening group OP1 includes a first opening 14*a* penetrating the side wall 14 of the housing 10, a first opening 15*a* penetrating the side wall 15 of the housing 10, a first opening 18*a* penetrating the middle wall 18, a first opening 24*a* penetrating the side wall 24 of the first sandwich structure 20, a first opening 25*a* penetrating the side wall 25 of the first sandwich structure 20, a first opening 44*a* penetrating the side wall 25 of the second sandwich structure 20, and a first opening 45*a* penetrating the side wall 45 of the second sandwich structure 40. The support structure 30 may include the first string piece 31 penetrating the corresponding first opening group OP1 and extending in a straight line. In other words, the first string piece 31 passes through the corresponding first openings 14*a*, 15*a*, 18*a*, 24*a*, 25*a*, 44*a*, and 45*a*, and is disposed in the first openings 14*a*, 15*a*, 18*a*, 24*a*, 25*a*, 44*a*, and 45*a*. In some embodiments, the support structure 30 may penetrate the first opening group OP1 in a one-piece manner. In some embodiments, each support structure 30 may include a single string piece (that is, the first string piece 31) (not shown in the drawings). In other embodiments, each support structure 30 may further include a plurality of string pieces.

In some embodiments, referring to FIG. 9 and FIG. 10, the two side walls 14 and 15 of the housing 10, the two side walls 24 and 25 of the first sandwich structure 20, and the two side walls 44 and 45 of the second sandwich structure 40 each include the foregoing first openings 14*a*, 15*a*, 24*a*, 25*a*, 44*a*, and 45*a*. In addition, the two side walls 14 and 15 of the housing 10, the middle wall 18, the two side walls 24 and 25 of the first sandwich structure 20, and the two side walls 44 and 45 of the second sandwich structure 40 each further include one or more other openings (hereinafter referred to as second openings 14*b*, 15*b*, 18*b*, 24*b*, 25*b*, 44*b*, and 45*b*). Here, the second openings 14*b*, 15*b*, 18*b*, 24*b*, 25*b*, 44*b*, and 45*b* aligned along a straight line form a second opening group OP2, and the support structure 30 further penetrates the second opening group OP2. In other words, the connector 1 may further include one or more second opening groups OP2 corresponding to the one or more support structures 30 respectively. Each second opening group OP2 includes a second opening 14*b* adjacent to a first opening 14*a* and penetrating the side wall 14 of the housing 10, a second opening 15*b* adjacent to a first opening 15*a* and penetrating the side wall 15 of the housing 10, a second opening 18*b* adjacent to a first opening 18*a* and penetrating the middle wall 18, a second opening 24*b* adjacent to a first opening 24*a* and penetrating the side wall 24 of the first sandwich structure 20, a second opening 25*b* adjacent to a first opening 25*a* and penetrating the side wall 25 of the first sandwich structure 20, a second opening 44*b* adjacent to a first opening 44*a* and penetrating the side wall 44 of the second sandwich structure 40, and a second opening 45*b* adjacent to a first opening 45*a* and penetrating the side wall 45 of the second sandwich structure 40. The support structure 30 includes the first string piece 31 penetrating the corresponding first opening group OP1 and extending in a straight line, and the second string piece 32 penetrating the corresponding second opening group OP2 and extending in a straight line. In other words, the first string piece 31 passes through the corresponding first openings 14*a*, 15*a*, 18*a*, 24*a*, 25*a*, 44*a*, and 45*a*, and is disposed in the first openings 14*a*, 15*a*, 18*a*, 24*a*, 25*a*, 44*a*, and 45*a*. The second string piece 32 passes through the corresponding second openings 14*b*, 15*b*, 18*b*, 24*b*, 25*b*, 44*b*, and 45*b*, and is disposed in the second openings 14*b*, 15*b*, 18*b*, 24*b*, 25*b*, 44*b*, and 45*b*.

Figure 11:
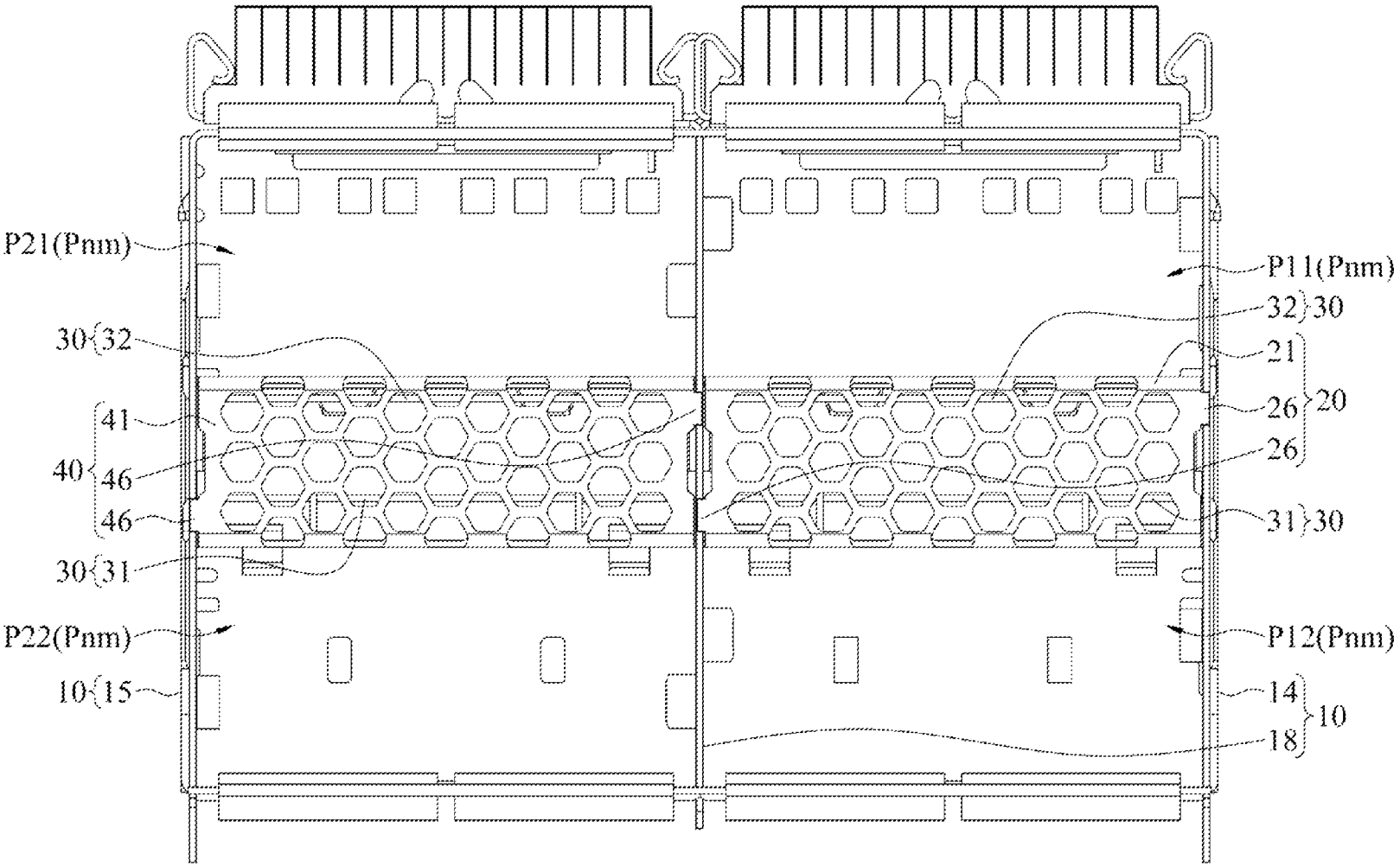
FIG. 11 is a front view of the connector in FIG. 9.
Figure 12:
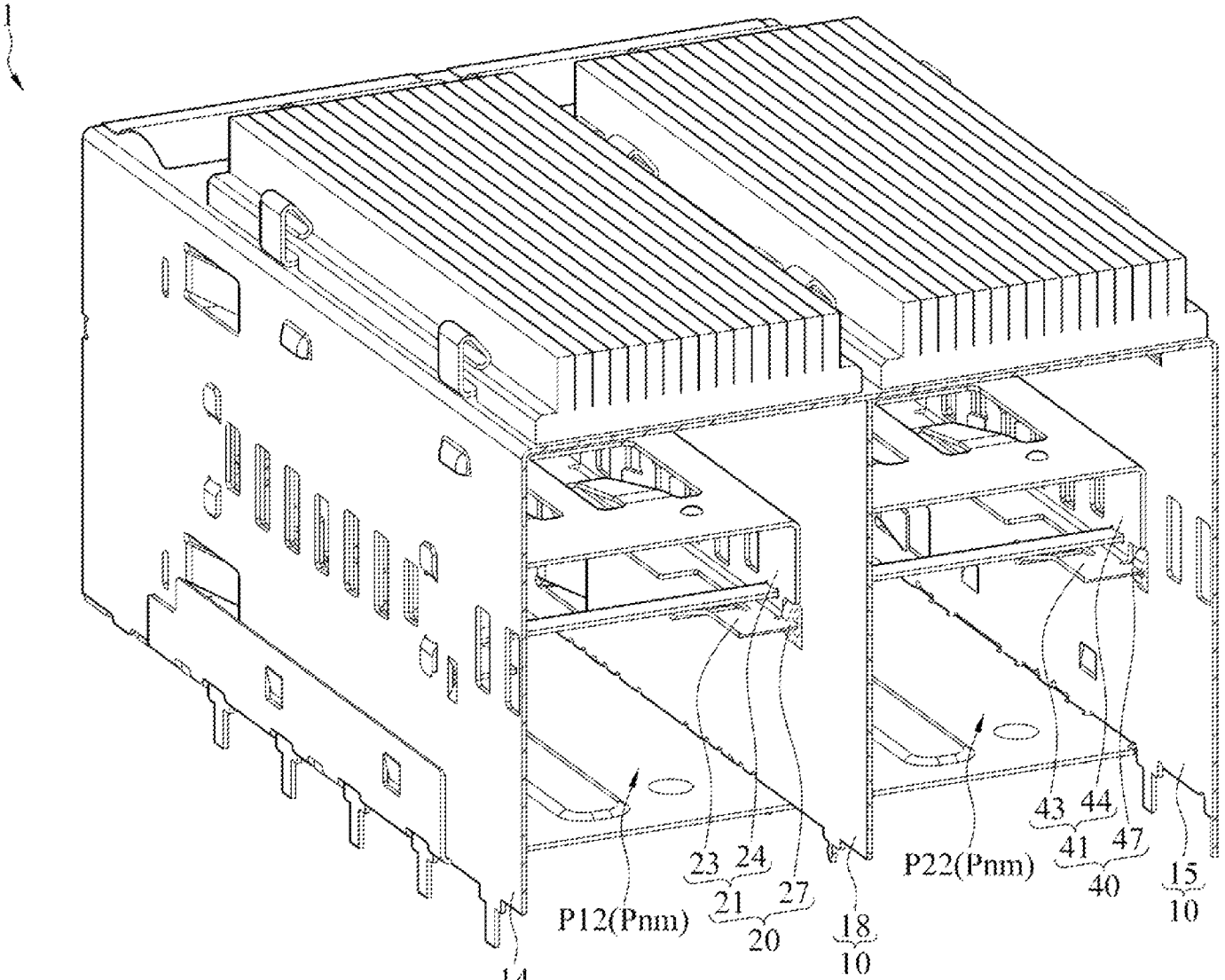
FIG. 12 is a sectional view taken along line II-II of FIG. 9 from an oblique viewing angle.
Figure 13:
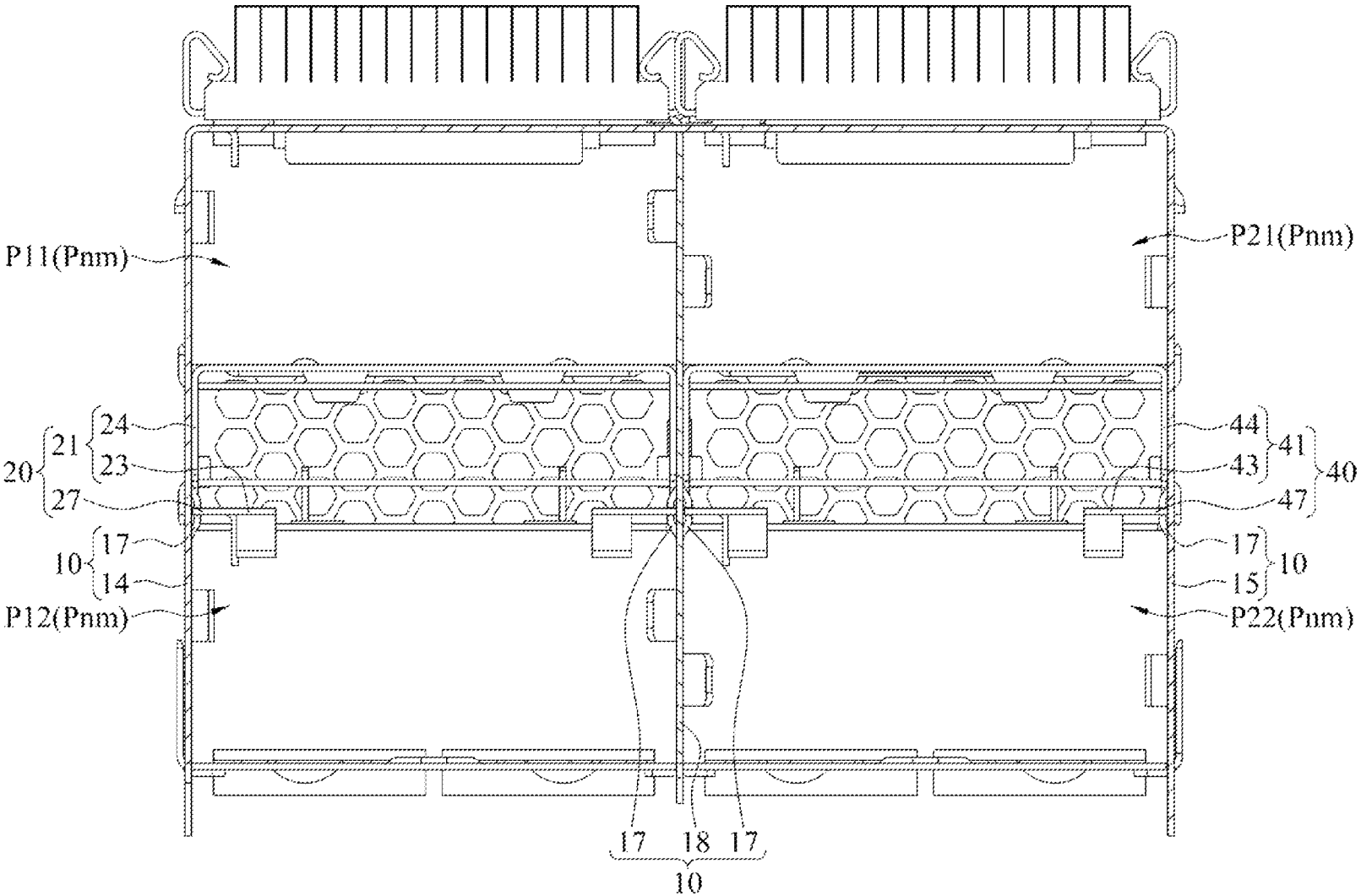
FIG. 13 is a sectional view taken along line II-II of FIG. 9 from a front viewing angle.

In some embodiments, referring to FIG. 9 to FIG. 11, the first sandwich structure 20 may include a body 21 and one or more first positioning structures 26. Each first positioning structure 26 is disposed on a first end of the body 21. The first end of the body 21 is adjacent to the inlets of the two accommodating cavities P11 and P12. When the first sandwich structure 20 is located in the housing 10, each first positioning structure 26 is clamped on the side wall 14 of the housing 10 (or the middle wall 18). In some examples, a clamping assembly between the first positioning structure 26 and the side wall 14 of the housing 10 (or the middle wall 18) may be a structural design such as the bump and notch clamped with each other as shown in the foregoing embodiment. In some embodiments, the first sandwich structure 20 may include a single first positioning structure 26. In an example, if the first sandwich structure 20 includes a single first positioning structure 26, the first positioning structure 26 may be located on a side, which is adjacent to the side wall 14 of the housing 10, of the first end of the body 21, so as to be clamped on the side wall 14 of the housing 10. In another example, if the first sandwich structure 20 includes a single first positioning structure 26, the first positioning structure 26 may be located on a side, which is adjacent to the middle wall 18, of the first end of the body 21, so as to be clamped on the middle wall 18. In another embodiment, the first sandwich structure 20 may include a plurality of first positioning structures 26, and the plurality of first positioning structures 26 are disposed at diagonal positions, as shown in FIG. 11. For example, the first positioning structures 26 are located on two sides of the first end of the body 21, so as to be clamped on the side wall 14 of the housing 10 and the middle wall 18 respectively.

In some embodiments, referring to FIG. 9 to FIG. 11, the second sandwich structure 40 may further include a body 41 and one or more first positioning structures 46. Each first positioning structure 46 is disposed on a first end of the body 41. The first end of the body 41 is adjacent to inlets of two accommodating cavities P11 and P12. When the second sandwich structure 40 is located in the housing 10, each first positioning structure 46 is clamped on the side wall 15 of the housing 10 (or the middle wall 18). In some examples, a clamping assembly between the first positioning structure 26 and the side wall 15 of the housing 10 (or the middle wall 18) may be a structural design such as the bump and notch clamped with each other as shown in the foregoing embodiment. In some embodiments, the second sandwich structure 40 may include a single first positioning structure 46. In an example, if the second sandwich structure 40 includes a single first positioning structure 46, the first positioning structure 46 may be located on a side, which is adjacent to the side wall 15 of the housing 10, of the first end of the body 41, so as to be clamped on the side wall 15 of the housing 10. In another example, if the second sandwich structure 40 includes a single first positioning structure 46, the first positioning structure 46 may be located on a side, which is adjacent to the middle wall 18, of the first end of the body 41, so as to be clamped on the middle wall 18. In another embodiment, the second sandwich structure 40 may include a plurality of first positioning structures 46, and the plurality of first positioning structures 46 are disposed at diagonal positions. For example, the first positioning structures 46 are located on two sides of the first end of the body 41, so as to be clamped on the side wall 15 of the housing 10 and the middle wall 18 respectively.

In some embodiments, referring to FIG. 9 to FIG. 13, the first sandwich structure 20 may further include one or more second positioning structures 27. Each second positioning structure 27 is disposed on a second end of the body 21. The second end of the body 21 is opposite to the first end of the body 21 and extends into the housing 10. When the first sandwich structure 20 is located in the housing 10, each first positioning structure 26 is clamped on the side wall 14 of the housing 10 (or the middle wall 18), and each second positioning structure 27 is clamped on the side wall 14 of the housing 10 (or the middle wall 18) inside the housing 10. In some examples, a clamping assembly between the second positioning structure 27 and the side wall 14 of the housing 10 (or the middle wall 18) may be a structural design such as the bump and clamping piece clamped with each other as shown in the foregoing embodiment.

In some embodiments, referring to FIG. 9 to FIG. 13, the second sandwich structure 40 may further include one or more second positioning structures 47. Each second positioning structure 47 is disposed on a second end of the body 41. The second end of the body 41 is opposite to the first end of the body 41 and extends into the housing 10. When the second sandwich structure 40 is located in the housing 10, each first positioning structure 46 is clamped on the side wall 15 of the housing 10 (or the middle wall 18), and each second positioning structure 47 is clamped on the side wall 15 of the housing 10 (or the middle wall 18) inside the housing 10. In some examples, a clamping assembly between the second positioning structure 47 and the side wall 15 of the housing 10 (or the middle wall 18) may be a structural design such as the bump and clamping piece clamped with each other as shown in the foregoing embodiment.

It can be learned from the above that when the configuration architecture of the connector 1 is that each horizontal row includes a plurality of accommodating cavities Pnm, the sandwich structure for separating the two accommodating cavities Pnm vertically adjacent to each other may alternatively be a plurality of sandwich structures (for example: the first sandwich structure 20 and the second sandwich structure 40 or more). In addition, in some embodiments, each sandwich structure may have the substantially the same structure, for example, including a body, including a body and one or more first positioning structures, or including a body, one or more first positioning structures and one or more second positioning structures. In addition, according to the position of each sandwich structure in the connector 1, the positioning structure (for example, the first positioning structure, or the second positioning structure) can be clamped on an adjacent wall according to the above (for example, the side wall 14 of the housing 10, the side wall 15 of the housing 10, or the middle wall 18). For example, when the configuration architecture of the connector 1 is 2X3 (that is, each horizontal row of the connector 1 includes three accommodating cavities Pnm and two middle walls 18 separate adjacent accommodating cavities Pnm sequentially), the connector 1 includes 3 sandwich structures. When the sandwich structure includes a positioning structure, the components and relative position relationship of a sandwich structure on the right side are the same as those the foregoing first sandwich structure 20, and the components and relative position relationship of a sandwich structure on the left side are the same as those of the foregoing second sandwich structure 40. For a sandwich structure in the middle, the components thereof are substantially the same as those of the foregoing first sandwich structure 20 or the second sandwich structure 40. However, the sandwich structure is adjacent to and located between the two middle walls 18. Therefore, the positioning structures on the sandwich structure are clamped on one of the two middle walls 18.

In summary, the connector according to any embodiment fixes the sandwich structures on the housing 10 by using the support structure 30 penetrating the sandwich structures (for example, the first sandwich structure 20, or the first sandwich structure 20 and the second sandwich structure 40) and the housing 10, thereby fixing the sandwich structure simply and stably. In some embodiments, the sandwich structures are provided with positioning structures (for example, the first positioning structures 26 and 46 and/or the second positioning structures 27 and 47) clamped on the housing 10 to fix the sandwich structures more stably. In some embodiments, when each sandwich structure includes a plurality of first positioning structures, the first positioning structures may be disposed at diagonal positions to fix the sandwich structures more stably. Besides, when there are a plurality of sandwich structures, interference between the first positioning structures of adjacent sandwich structures can be avoided. In some embodiments, two ends of the body are provided with positioning structures clamped on the housing 10 to fix the sandwich structures more stably.

What is claimed is:

1. A connector, comprising:

a housing, comprising two accommodating cavities vertically adjacent to each other, wherein each accommodating cavity is configured to receive a docking connector;

a first sandwich structure, disposed between the two accommodating cavities, wherein the first sandwich structure comprises a body and a first positioning structure, the first positioning structure is disposed on a first end of the body, the first end of the body is adjacent to inlets of the two accommodating cavities, and the first positioning structure is clamped on a side wall of the housing; and a support structure, penetrating two of the side walls of the housing and two side walls of the first sandwich structure to fix the first sandwich structure on the housing.

2. The connector according to claim 1, wherein each of the two side walls of the housing and the two side walls of the first sandwich structure comprises a first opening, the first openings form a first opening group aligned along a straight line, and the support structure penetrates the first opening group.

3. The connector according to claim 2, wherein each of the two side walls of the housing and the two side walls of the first sandwich structure further comprises a second opening, the second openings form a second opening group aligned along a straight line, and the support structure penetrates the second opening group.

4. The connector according to claim 3, wherein the support structure comprises a first string piece penetrating the first opening group and a second string piece penetrating the second opening group.

5. The connector according to claim 3, wherein the support structure penetrates the first opening group and the second opening group in a one-piece manner.

6. The connector according to claim 1, wherein the first sandwich structure further comprises a second positioning structure, the second positioning structure is disposed on a second end of the body, the second end is opposite to the first end and extends into the housing, and the second positioning structure is clamped on the side wall of the housing inside the housing.

7. A connector, comprising:

a housing, comprising two first accommodating cavities and two second accommodating cavities, wherein the two first accommodating cavities are vertically adjacent to each other, and each first accommodating cavity is configured to receive a docking connector, the two second accommodating cavities being located on sides of the two first accommodating cavities and being vertically adjacent to each other, the first accommodating cavity and the second accommodating cavity adjacent to each other being separated by a middle wall;

a first sandwich structure, disposed between the two first accommodating cavities;

a second sandwich structure, disposed between the another two second accommodating cavities; and a support structure penetrating the two side walls of the housing, the two side walls of the first sandwich structure, the middle wall, and two side walls of the second sandwich structure to fix the first sandwich structure and the second sandwich structure on the housing.

8. The connector according to claim 7, wherein each of the first sandwich structure and the second sandwich structure comprises a body and at least a first positioning structure disposed on a first end of the body, the first end of the body is adjacent to an inlet of the housing, and each first positioning structure is clamped on the side wall of the housing or the middle wall.

9. The connector according to claim 8, wherein each of the first sandwich structure and the second sandwich structure comprises a plurality of the first positioning structures disposed at diagonal positions and clamped on the side wall of the housing and the middle wall separately.

10. The connector according to claim 7, wherein one of the two side walls of the housing, the two side walls of the first sandwich structure, and the middle wall comprises a first opening, the first openings form a first opening group aligned along a straight line, and the support structure penetrates the first opening group.

11. The connector according to claim 10, wherein the support structure comprises a first string piece penetrating the first opening group.

12. The connector according to claim 7, wherein each of the two side walls of the housing, the two side walls of the first sandwich structure, the middle wall, and two side walls of the second sandwich structure comprises a first opening, the first openings form a first opening group aligned along a straight line, and the support structure penetrates the first opening group.

13. The connector according to claim 12, wherein the support structure comprises a first string piece penetrating the first opening group.

14. The connector according to claim 12, wherein each of the two side walls of the housing, the two side walls of the first sandwich structure, the middle wall, and two side walls of the second sandwich structure further comprises a second opening, the second openings form a second opening group aligned along a straight line, and the support structure penetrates the second opening group.

15. The connector according to claim 14, wherein the support structure comprises a first string piece penetrating the first opening group and a second string piece penetrating the second opening group.

16. The connector according to claim 14, wherein the support structure penetrates the first opening group and the second opening group in a one-piece manner.

17. The connector according to claim 7, wherein the first sandwich structure comprises a body and a first positioning structure, the first positioning structure is disposed on a first end of the body, the first end of the body is adjacent to an inlet of the housing, and the first positioning structure is clamped on the side wall of the housing or the middle wall.

18. The connector according to claim 7, wherein the first sandwich structure comprises a body and a second positioning structure, the second positioning structure is disposed on a second end of the body, the second end is opposite to an inlet of the housing and extends into the housing, and the second positioning structure is clamped on the side wall of the housing or the middle wall inside the housing.

* * * * *